United States Patent [19]

Ernst et al.

[11] 4,248,295

[45] Feb. 3, 1981

[54] FREEZABLE HEAT PIPE

[75] Inventors: Donald M. Ernst, Leola; James L. Sanzi, Lancaster, both of Pa.

[73] Assignee: Thermacore, Inc., Lancaster, Pa.

[21] Appl. No.: 112,901

[22] Filed: Jan. 17, 1980

[51] Int. Cl.[3] ..... F28D 15/00

[52] U.S. Cl. ..... 165/105; 165/134 R

[58] Field of Search ..... 165/105, 134

[56] References Cited

U.S. PATENT DOCUMENTS 3,777,811 12/1973 Shcosinger ..... 165/105

4,058,159 11/1977 Iriarte ..... 165/105

*Primary Examiner*—Albert W. Davis

*Attorney, Agent, or Firm*—Martin Fruitman

[57] ABSTRACT

A heat pipe whose fluid can be repeatedly frozen and thawed without damage to the casing. An additional part is added to a conventional heat pipe. This addition is a simple porous structure, such as a cylinder, self-supporting and free standing, which is dimensioned with its diameter not spanning the inside transverse dimension of the casing, and with its length surpassing the depth of maximum liquid.

7 Claims, 2 Drawing Figures

FREEZABLE HEAT PIPE

BACKGROUND OF THE INVENTION

The field of this invention, generally, is heat exchangers, and, more particularly, it deals with the type of condensing and evaporating system referred to in the art as a heat pipe.

While water is a highly desirable heat pipe fluid for operating temperatures between 50° C. and 250° C. because of its high latent heat of vaporization, a severe limitation exists in the potential threat of damage to a water loaded heat pipe, due to freezing of the water.

When a water heat pipe freezes, the expansion resulting as the water changes to ice can cause rupture of the heat pipe casing in much the same way as household plumbing is damaged by freezing.

The freezing problem is particularly serious if a heat pipe freezes when in a vertical or in an inclined position rather than in the horizontal position. In such situations a puddle of water which spans the entire diameter can form at the lower end of the heat pipe, and such a puddle, when frozen, exerts considerable force on the heat pipe wick and casing, frequently causing rupture of the casing.

One approach to solving this problem to date has been the most obvious one, preventing freezing of the liquid. However, in commercial, as opposed to laboratory, operations such precautions are not always feasible, and the actual result has been a reluctance to use freezing prone liquids, such as water, in heat pipes.

A second method of freeze damage prevention is shown in U.S. Pat. Nos. 4,194,559, 956,680 by Eastman. In that patent the quantity of liquid loaded into the heat pipe is limited to the quantity which will be retained in the wick at all times. The puddle at the bottom of the heat pipe therefore never forms, and thus cannot exert destructive forces on the casing.

To date, however, there is no wickless heat pipe or a heat pipe with non-critical fluid fill which will survive repeated freeze-thaw cycles without damage.

SUMMARY OF THE INVENTION

The present invention solves the freezing problem by the addition of a part to the heat pipe, and can be used in either wicked or wickless heat pipes. The additional part operates as a relief mechanism within the heat pipe and apparently modifies the circumstances of the freezing action so as to prevent destructive forces.

The addition is a self-supporting, free standing, porous structure, such as a cylinder or rectangular prism, which extends over a considerable portion of the length of the heat pipe.

The actual required dimensions of the porous structure are not critical, but some criteria have been determined experimentally. Referenced to the typical heat pipe construction in which the casing is a cylinder and the heat transfer is axial along the cylinder, it has been determined that the porous structure should not completely span the diameter of the casing. In other heat pipe configurations the criteria would simply be that the boundaries of the porous structure should not completely span the volume of the casing into which the liquid collects.

The height of the porous structure is determined essentially by the liquid depth. In the typical cylindrical case, the porous structure must be at least as long as the depth of liquid when the heat pipe is oriented with its axis vertical. While the porous structure will operate satisfactorily if it spans the entire axial length of the heat pipe, it is not necessary that it have that maximum length. A short structure, however, must be freely movable, so that the structure will follow the liquid to the lowest point of the casing. As long as an end of the porous structure reaches the lowest level of the liquid, the heat pipe will not be damaged by freezing.

DETAILED DESCRIPTION OF THE INVENTION

Figure 1:
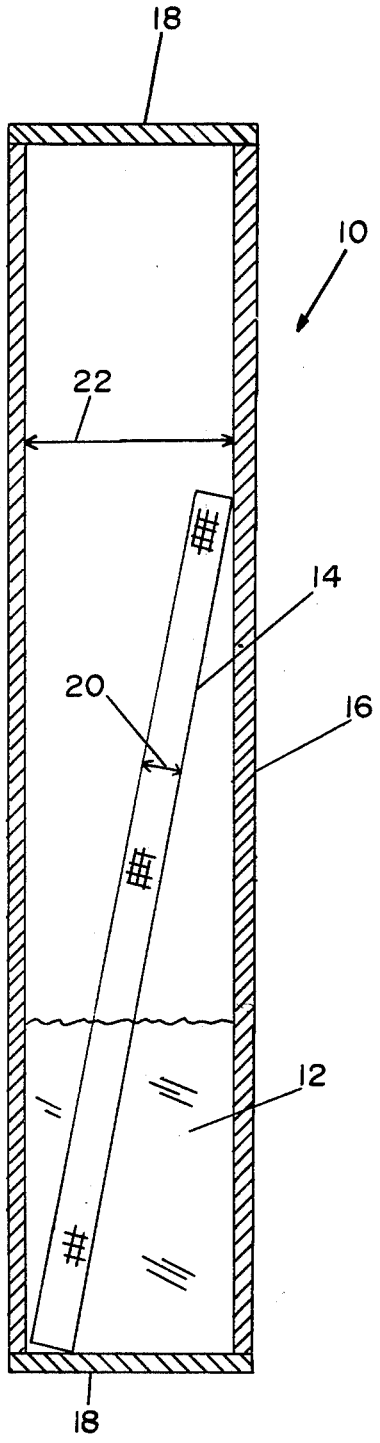
FIG. 1 is a cross sectional view of the preferred embodiment of the invention in the form of a cylindrical heat pipe.

FIG. 1 is a cross sectional view of the invention in which heat pipe 10 contains liquid 12 and porous structure 14. Heat pipe 10 is constructed of casing 16, typically cylindrical, which is sealed at both ends by end caps 18. Within heat pipe 10 is a volume of liquid 12 which evaporates when heat is applied to the portion of casing 16 near the liquid. The vapor formed then condenses at an unheated portion of casing 16 and runs back down to liquid pool 12 by gravity. Heat pipes also operate independent of gravity when a wick is mounted adjacent to the inside of casing 16 to transport liquid by capillary action.

The present invention is, however, most pertinent to an inoperative heat pipe, because without heat applied to casing 16, a considerable quantity of liquid exists in a pool at the lowest point of any heat pipe in a gravity environment. It is at that location that damage is most likely to occur upon freezing of the liquid.

The present invention prevents destruction despite freezing by the presence of porous structure 14 within the heat pipe in the orientation depicted in FIG. 1. The required orientation has several major criteria. The first is that the length of porous structure 14 should normally exceed the depth of liquid pool 12. Since thermal conduction throughout the liquid is a part of the function of the structure, for non-critical applications such as slower freezing rates, a length somewhat less than the depth of the liquid will also serve to prevent freezing.

A related criteria of porous structure 14 is that, if, as shown in FIG. 1, it is free standing, that is, not attached to casing 16 or end caps 18 for support, it must be self-supporting. The free standing, self-supporting embodiment is depicted because it is clearly the simplest to construct, since no mounting arrangements are required.

A further criteria of porous structure 14 is that, unlike a typical heat pipe wick structure, it must not span the inside dimension of casing 16. That is, the width or diameter 20 of porous structure 14 must not equal the inside dimension 22 of casing 16. As these dimensions approach each other, the action of porous structure 14 in relieving damage inducing forces is reduced.

An additional criteria for porous structure 14 is that, if, as shown in FIG. 1, it does not fully span the length of heat pipe 10, and, furthermore, if heat pipe 10 can be inverted in use to cause liquid pool 12 to form at the other end, then porous structure 14 must be free moving to follow the liquid pool. Similarly, if heat pipe 10 is of a complex shape and the location of liquid pool 12 is optional at several locations, porous structure 14 must be constructed to follow the location of liquid pool 12.

The final criteria for porous structure 14 is that it must be constructed and oriented to permit one part of it to rest at the lowest level of liquid in the casing. Typically such a criteria means that width 20 of porous structure 14 must be smaller than the width of the heat pipe at end caps 18, and end caps 18 must not include complex shapes or depressions which would permit a quantity of liquid to fill a volume at a level lower than the liquid in proximity to porous structure 14.

Figure 2:
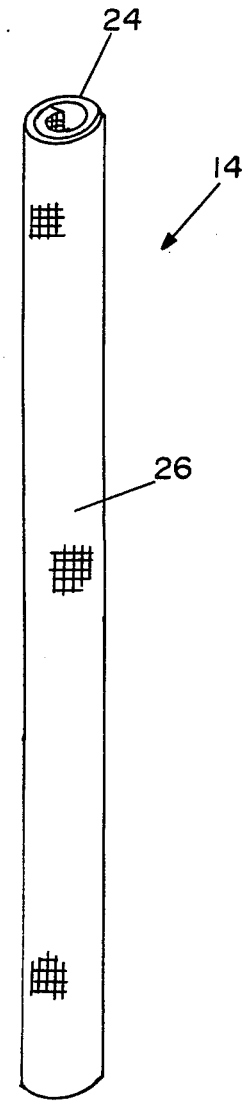
FIG. 2 is a perspective view of a typical screen cylinder which serves as the porous structure of the invention.

FIG. 2 shows the construction of a simple typical porous structure 14 in the general configuration of a cylinder. Beyond the criteria noted above, the structure must have some perceptible volume. The structure shown in FIG. 2 is constructed simply by wrapping several turns 24 of mesh material 26 into cylinder 14 and fixing the shape by some conventional method such as spot welding.

Several examples of the structure of the invention have been subjected to rigorous testing as follows.

For purposes of experimentation with the invention, and despite the fact that glass makes a poor heat pipe casing, 1 millimeter wall glass tubing with 13 millimeter I.D. was used as casing material. With a length of 35 cm. and approximately 10 cc. of water fill which reached a depth of 6.5 cm., and without the present invention, the bottom fell out of the tubing on the second freeze-thaw cycle.

With an identical casing and water fill, but with the addition of a porous structure constructed of 347 stainless steel screen of 80×80 mesh, rolled into a 3 millimeter I.D., 5 millimeter O.D. cylinder 15 cm. long, the casing survived more than 40 freeze-thaw cycles without damage.

Another test was run on two similar structures with steel outer casing which differed only in the fact that one internal structure was constructed of sheet steel and the other of the same sheet steel with multiple small holes throughout the sheet. The casing was constructed of 1/32 wall 7/16 inch I.D. steel, 48 inches long and filled with 12 inches of water when in the vertical position. The internal structure was 3 wraps of shim stock forming a 7/32 O.D., 5/32 I.D., 13-inch long cylinder. On test, the unit with solid shim stock showed measurable diametric expansion with repeated freeze-thaw cycles, and ultimately failed at 63 cycles. The identical unit differing only in that the shim stock contained small holes has survived more than 100 cycles with no indication whatsoever of any diametric expansion. The inference is that no freeze related failure will ever occur.

The criteria of porosity is critical to the survival of the heat pipe, and the standard of porosity is considered to be that which permits free liquid flow to the interior of the porous structure at all depths of the liquid from all directions.

It is to be understood that the form of the invention herein shown is merely a preferred embodiment. Various changes may be made in the size, shape and the arrangement of parts; equivalent means may be substituted for those illustrated and described; and certain features may be used independently from others without departing from the spirit and scope of the invention as defined in the following claims.

For instance, the porous structure could also be constructed of sintered powder material to accomplish the required porosity.

What is claimed as new and desired to be secured by Letters Patent of the United States is:

1. A heat pipe capable of surviving repeated freezing and thawing cycles without damage comprising:

a sealed outer casing;

a heat exchange liquid; and a porous structure within the sealed outer casing dimensioned with a length approximating the maximum possible depth of liquid when the heat pipe axis is oriented parallel to the force of gravity, and a width less than the span across the inside of the sealed casing, and oriented so that a portion of the porous structure is always at the lowest level of liquid within the casing when the liquid spans the diameter of the casing.

2. A heat pipe capable of surviving repeated freezing and thawing cycles without damage, as in claim 1, wherein the porous structure comprises a cylinder of mesh screen.

3. A heat pipe capable of surviving repeated freezing and thawing cycles without damage, as in claim 1, wherein the porous structure comprises a cylinder with multiple holes permitting free liquid flow to the interior of the cylinder at all depths of liquid.

4. A heat pipe capable of surviving repeated freezing and thawing cycles without damage, as in claim 1, wherein the porosity of the porous structure affords free liquid flow from all directions between the interior and exterior of the porous cylinder at all depths of liquid.

5. A heat pipe capable of surviving repeated freezing and thawing cycles without damage, as in claim 1, wherein the porous structure is free to move axially with the liquid within the casing if the casing orientation is changed.

6. A heat pipe capable of surviving repeated freezing and thawing cycles without damage, as in claim 1, wherein the porous structure is self-supporting.

7. A heat pipe capable of surviving repeated freezing and thawing cycles without damage, as in claim 1, wherein the porous structure is free standing.

* * * * *

UNITED STATES PATENT AND TRADEMARK OFFICE
CERTIFICATE OF CORRECTION

PATENT NO. : 4,248,295

DATED : February 3, 1981

INVENTOR(S) : Donald M. Ernst and James L. Sanzi

It is certified that error appears in the above-identified patent and that said Letters Patent is hereby corrected as shown below:

Column 1, between lines 4 and 5 insert the following paragraph --

The U.S. Government has a paid-up license in this invention and the right in limited circumstances to require the patent owner to license others on reasonable terms as provided for by the terms of contract No. DE-AC04-88-CS04099 awarded by the U.S. Department of Energy.

Signed and Sealed this

*Ninth* Day of *March 1982*

[SEAL]

*Attest:*

GERALD J. MOSSINGHOFF

*Attesting Officer* *Commissioner of Patents and Trademarks*